US007246415B2

(12) United States Patent
Takatori et al.

(10) Patent No.: US 7,246,415 B2
(45) Date of Patent: Jul. 24, 2007

(54) ZIPPER AND THE PACKAGING THEREWITH

(75) Inventors: Tatsushi Takatori, Shiki (JP); Yoshio Ohya, Sano (JP); Naoki Hatakeyama, Hiratsuka (JP)

(73) Assignee: C.I. Sanplus Co., Ltd., Tokyo (JP)

( * ) Notice: Subject to any disclaimer, the term of this patent is extended or adjusted under 35 U.S.C. 154(b) by 35 days.

(21) Appl. No.: 11/087,872

(22) Filed: Mar. 24, 2005

(65) Prior Publication Data

US 2006/0213038 A1 Sep. 28, 2006

(51) Int. Cl.
*A44B 19/16* (2006.01)

(52) U.S. Cl. ..... 24/399; 383/63

(58) Field of Classification Search ..... 24/399; 383/63

See application file for complete search history.

(56) References Cited

U.S. PATENT DOCUMENTS 5,655,273 A * 8/1997 Tomic et al. ..... 24/584.1

FOREIGN PATENT DOCUMENTS

| | | |
|---|---|---|
| JP | H06-37097 | 5/1994 |
| JP | H07-257602 | 10/1995 |
| JP | H09-066947 | 3/1997 |
| JP | H10-297652 | 11/1998 |
| JP | H10-297653 | 11/1998 |

* cited by examiner

*Primary Examiner*—Jack W. Lavinder
(74) *Attorney, Agent, or Firm*—Buchanan Ingersoll & Rooney PC

(57) ABSTRACT

[PROBLEM] To provide a interlocking device and a packaging bag therewith wherein the interlocking device has sufficient heat stability against retort sterilization treatment and deformational change after said treatment small enough not to be impaired its reopenability.

[SOLUTION MEANS] A interlocking device having a pair of male and female profiles wherein:

said male and female profiles have non-heat-sealing part to bag body and heat-sealing part to bag body; where said non-heat-sealing part consists of polypropylene type resin composition (A) having main melting peak temperature observed by differential scanning calorimetry less than 150 degree C. and the melt flow rate at 230 degree C. from 0.5 g/10 min to 20 g/10 min; and said heat-sealing part consists of polypropylene type resin composition (B) having main melting peak temperature observed by DSC, not less than 140 degree C. and the melt flow rate at 230 degree C. from 0.1 g/10 min to 20 g/10 min; and the main melting peak temperature of polypropylene type resin composition (B) is at least 10 degree C. lower than that of polypropylene type resin composition (A), and a packaging bag with interlocking device wherein the aforesaid interlocking device is heat-sealed to the bag body via said heat sealing part.

2 Claims, 1 Drawing Sheet

ZIPPER AND THE PACKAGING THEREWITH

BACKGROUND OF THE INVENTION

1. Field of the Invention

The present invention relates to a interlocking device and a packaging bag therewith wherein the interlocking device has sufficient heat stability against retort sterilization treatment and dimensional change after said treatment small enough not to be impaired its reclosability.

2. Background of the Invention

A packaging bag which is made reclosable by attaching a interlocking device having a pair of male and female profiles at its opening (zippered bag) are widely used in a lot of fields such as food, medicine, and miscellaneous goods etc. Various methods are proposed as a process for the manufacture of the bag with an interlocking device. For example, a method to extrude a tubular film combined a pair of male and female profile on it with circular die, a method to attach the interlocking device extruding on to a film, a method to attach an interlocking device prepared beforehand on to a film substrate by heat sealing or setting with adhesives.

However, since the first and second methods have drawbacks such as the limitation of resin types applicable, difficulty to adopt them to multi-layered film substrate, limitation to deploy to various sizes, difficulty to print etc., it is commonly employed to attach an interlocking device prepared beforehand on to a film substrate by heat sealing.

As the materials for interlocking devices, polyethylene type resin and polypropylene type resin are widely adopted. In the case the heat-sealing part of interlocking device is polypropylene type resin, the following laminated film are used as a bag's body film substrate for heat sealing: OPP/CPP (oriented polypropylene/non-oriented polypropylene), ONy/CPP (oriented nylon/non-oriented polypropylene), PET/CPP (oriented polyester/non-oriented polypropylene), ONy/Al/CPP (oriented nylon/aluminum foil/non-oriented polypropylene), and PET/Al/CPP (oriented polyester/aluminum foil/non-oriented polypropylene) etc. In recent years, the improvement of film functionalities makes it easier to blocking microorganism completely by film packaging, and it is becoming more popular to transforming bottles and cans to retort pouches. With such transformation, an interlocking device is become required high heat resistance in addition to its original functionality of easy-reclosability.

The interlocking device made of polypropylene type resin used so far has good low temperature heat sealability to a film substrate, however, it has problems such that it is deformed, shrunk or melt bonded by the heat applied during the retort sterilization and loses not only its sealing tightness, but also its reclosability. Furthermore, those polypropylene type interlocking devices used so far usually have a single layer structure, not a multi layer structure so that the polypropylene type resin having high melting temperature shall be used to make the interlocking device which does not deform, shrink and melt bond by the heat applied during retort sterilization. This has a disadvantage that the heat sealing temperature must be increased. As therefore, there is no interlocking device having single layered structure with both low temperature heat sealability and heat stability sufficient to stand under retort sterilization.

DESCRIPTION OF THIS INVENTION

PROBLEM TO BE SOLVED BY THE PRESENT INVENTION

In order to solve the aforesaid problem, this invention provides an interlocking device has high heat stability sufficient to stand retort sterilization, deformation after sterilization low enough not to suffer its reclosability, and low temperature heat sealability. This invention also provides a packaging bag having said interlocking device.

SUMMARY OF THE INVENTION

The inventors have extensively studied to solve the aforesaid problems, and came to find the above-mentioned problem being able to be solved by making the interlocking device have the multilayered structure consist of resin compositions (A) and (B) wherein the composition (A) is a certain polypropylene type resin composition (A) for the non-heat-sealing part and the composition (B) is a certain polypropylene type resin composition (B) for the heat-sealing part.

Thus, the present invention is related to an interlocking device featured by having a pair of male and female profiles wherein:

said male and female profiles have non-heat-sealing part to bag body and heat-sealing part to bag body; where said non-heat-sealing part consists of polypropylene type resin composition (A) having main melting peak temperature observed by differential scanning calorimetry (DSC), not less than 150 degree C., and the melt flow rate at 230 degree C. from 0.5 g/10 min to 20 g/10 min; and said heat-sealing part consists of polypropylene type resin composition (B) having main melting peak temperature observed by DSC, not less than 140 degree C. and the melt flow rate at 230 degree C. from 0.1 g/10 min to 20 g/10 min; and the main melting peak temperature of polypropylene type resin composition (B) is at least 10 degree C. lower than that of polypropylene type composition (A).

BENEFIT OF THE INVENTION

The interlocking device of the present invention and a packaging bag with the interlocking device possess superior heat stability, better heat sealability than those having the single layered structure, excellent reclosability, and high sealing strength.

The polypropylene type resin composition (A) is the composition whose main melting peak temperature observed by differential scanning thermometry (DSC), not less than 150 degree C. and whose melt flow rate is from 0.5 g/10 min to 20 g/10 min, preferably from 1 g/10 min to 15 g/10 min. The composition (A) consists of propylene homopolymer or a copolymer of propylene and other alfa-olefin, and said copolymer is a copolymer of propylene and one or more of alfa-olefins, e.g., ethylene, butane, hexane etc., and may be random copolymer or block copolymer. The composition (A) may be a single resin or a composition of two or more resins.

The main melting peak temperature of the composition (A) is defined because the condition regarding the dimensional change against its original dimension before the treatment to immerse the interlocking device to a glycerin bath whose temperature is controlled at 135 degree C. for 15 min and then to take out, leave and cool down for 30 min can not be satisfied when the peak temperature is lower than 150 degree C. The melt flow rate of the composition (A) is defined because the extrudability is inferior when the rate is lower than 0.5 g/10 min and the molding stability is inferior when the rate is higher than 20 g/10 min.

The polypropylene type resin composition (B) is the composition whose main melting peak temperature observed by DSC, not less than 140 degree C. and whose melt flow rate is from 0.5 g/10 min to 20 g/10 min, preferably from 1 g/10 min to 15 g/10 min. The composition (B) consists of propylene homopolymer or copolymer of propylene and other alfa-olefin, and said copolymer is a copolymer of propylene and one or more of alfa-olefins, e.g., ethylene, butane, hexane etc., and may be random copolymer or block copolymer. The composition (B) may be a single resin or a composition of two or more resins.

The main melting peak temperature of the composition (B) is defined because the composition melts when it is immersed to a glycerin bath at 135 degree C. for 15 min if the peak temperature is lower than 140 degree C. The melt flow rate of the composition (B) is defined because the extrudability is inferior when the rate is lower than 0.5 g/10 min and the molding stability is inferior when the rate is higher than 20 g/10 min.

The main melting peak temperature of polypropylene type resin composition (B) shall be at least 10 degree C. lower than that of polypropylene type resin composition (A) because, when the difference is smaller than 10 degree C., the main peak temperature difference between the non-heat-sealing part to the bag body and the heat-sealing part is too small and this results insufficient improvement in the heat sealability to the bag body and the bag body substrate could be damaged.

In the interlocking device of the present invention, there is no limitation in the shapes and number of male and female profiles and any shape can be chosen which has reclosability.

Further, any heretofore known additives, e.g., stabilizers, anti-oxidants, lubricants, anti-static agents, colorants etc., can be used in any extent unless those additives result in interference with purpose of this invention.

FIG. 1 is the schematic image of an example of the present invention's interlocking device describing the structure of non-heat-sealing and heat-sealing parts.

FIG. 2 is the schematic image of another example of the present invention's interlocking device describing the structure of non-heat-sealing and heat-sealing parts.

FIG. 3 is the schematic image of front view of present invention's packaging bag.

FIG. 4 is the schematic image of cross sectional view at II—II line in FIG. 3.

EXAMPLES

Hereafter, the present invention will be further illustrated by examples and comparative examples; however, the present invention is not limited by these examples.

<Main Melting Peak Temperature>

The main melting peak temperature was measured by the differential scanning calorimeter model DSC-7 made by Perkin-Elmer Corporation in conformity with JIS K7121 at the heating rate of 10 degree C./minute.

<Melt Flow Rate>

The melt flow rate was measured by Meltindexer made by Toyo Seiki Seisakusho in conformity with JIS K7210 at 230 degree C. and 2.16 kg loading.

<Heat Shrinkage>

The heat shrinkage is calculated by the following equation according to the dimension (a) measured before immersion to the glycerin bath controlled at 135 degree C. and dimension (b) measured after leaving to cool for 30 minutes following immersing 15 minutes into the said glycerin bath.

$$\text{Heat shrinkage } (\%)=((a)-(b))/(a)\times 100$$

<Heat Sealing>

Samples were prepared by heat-sealing the sealing layer of substrate film and sealing area of the interlocking device with the heat gradient tester made by Toyo Seiki Seisakusho. The substrate film is PET/ONy/Al/CPP(12μ/15μ/7μ/80μ). The piece of the sealing area of the interlocking device was cut from the flat part of the un-open side of male profile in the size of 5 mm wide and 25 cm long. The sealing condition of the heat gradient tester was 1.0 kg-f/cm2 of sealing pressure and 1.0 second of sealing time.

<Sealing Temperature Measurement>

The aforesaid heat sealed sample specimens' sealing strength between the sealing layer of substrate film and sealing area of the interlocking device was measured with Strograph tensile strength tester made by Toyo Seiki Seisakusho. The sealing temperature was defined as the temperature at which the sealing strength between the sealing layer of substrate film and sealing area of the interlocking device was reached greater than 1.5 kg, inclusive. The head speed for the sealing strength measurement was 200 mm/minute and aforesaid heat sealing and heat sealing temperature measurement were performed in the temperature-controlled room at 23 degree C. and 50% relative humidity.

Example 1

The resin composition that consisted of 100 wt % of propylene homopolymer (Noblen FS2016 made by Sumitomo Chemical Co. Ltd.), whose main melting peak temperature measured by DSC is 160 degree C. and melt flow rate is 2.1 g/10 min, was prepared as non-heat-sealing part of the interlocking device. The resin composition that consisted of 100 wt % of ethylene-propylene-buten-1 random polymer (Noblen FL8115 made by Sumitomo Chemical Co. Ltd.), whose main melting peak temperature measured by DSC is 148 degree C. and melt flow rate is 7.5 g/10 min, was prepared as heat-sealing part of the interlocking device.

These compositions were melt-kneaded at 210 degree C. in the extruders whose diameter is 40 mm and L/D is 25 for non-heat-sealing part and diameter is 30 mm and L/D is 25 for heat-sealing part, respectively, then introduced to the composition die with male and female profiles, co-extruded, and introduced to a cooling bath for solidification. Thereafter, the interlocking device of Example 1 is finally wound by a winder. The heat shrinkage and sealing temperature is shown in the Table 1.

Example 2

The interlocking device of Example 2 was obtained by the similar procedure as described in EXAMPLE 1 except for using the resin composition that consisted of 100 wt % of ethylene-propylene block copolymer (Exellen KS351E1 made by Sumitomo Chemical Co. Ltd.), whose main melting peak temperature measured by DSC is 162 degree C. and melt flow rate is 2.5 g/10 min, for the non-heat-sealing part of the interlocking device and the resin composition that consisted of 100 wt % of ethylene-propylene-buten-1 random polymer (Noblen FL6412 made by Sumitomo Chemical Co. Ltd.), whose main melting peak temperature measured by DSC is 142degree C. and melt flow rate is 6.0 g/10 min, for the heat-sealing part of the interlocking device. The heat shrinkage and sealing temperature is shown in the Table 1.

Comparative Example 1

The interlocking device of Comparative Example 1 was obtained by the similar procedure as described in EXAMPLE 1 except for using the resin composition that consisted of 100 wt % of ethylene-propylene block copolymer (Exellen KS3511E1 made by Sumitomo Chemical Co. Ltd.), whose main melting peak temperature measured by DSC is 162 degree C. and melt flow rate is 2.5 g/10 min, for the non-heat-sealing part of the interlocking device and the resin composition that consisted of 100 wt % of ethylene-propylene copolymer (Noblen FS2016 made by Sumitomo Chemical Co. Ltd.), whose main melting peak temperature measured by DSC is 160 degree C. and melt flow rate is 2.1 g/10 min, for the heat-sealing part of the interlocking device. The heat shrinkage and sealing temperature is shown in the Table 1.

Comparative Example 2

The interlocking device of Comparative Example 2 was obtained by the similar procedure as described in EXAMPLE 1 except for using the resin composition that consisted of 100 wt % of propylene homopolymer (Noblen FS2016 made by Sumitomo Chemical Co. Ltd.), whose main melting peak temperature measured by DSC is 160 degree C. and melt flow rate is 2.1 g/10 min, for the non-heat-sealing part of the interlocking device and the resin composition that consisted of 100 wt % of ethylene-propylene copolymer (Mitsui-Sumitomo Polypro FS3611 made by Mitsui-Sumitomo Polyolefin Co. Ltd.), whose main melting peak temperature measured by DSC is 132 degree C. and melt flow rate is 3.6 g/10 min, for the heat-sealing part of the interlocking device. The heat shrinkage and sealing temperature is shown in the Table 1.

Comparative Example 3

The interlocking device of Comparative Example 3 was obtained by the similar procedure as described in EXAMPLE 1 except for using the resin composition that consisted of 100 wt % of propylene homopolymer (Noblen FS2016 made by Sumitomo Chemical Co. Ltd.), whose main melting peak temperature measured by DSC is 160 degree C. and melt flow rate is 2.1 g/10 min, for both the non-heat-sealing part and the heat-sealing part of the interlocking device. The heat shrinkage and sealing temperature is shown in the Table 1.

Comparative Example 4

The interlocking device of Comparative Example 4 was obtained by the similar procedure as described in EXAMPLE 1 except for using the resin composition that consisted of 100 wt % of ethylene-propylene-butene-1 random copolymer (Noblen FS8115 made by Sumitomo Chemical Co. Ltd.), whose main melting peak temperature measured by DSC is 148 degree C and melt flow rate is 7.5 g/10 min, for both the non-heat-sealing part and the heat-sealing part of the interlocking device. The heat shrinkage and sealing temperature is shown in the Table 1.

TABLE 1

| | Main Peak Temperature of non-heat-sealing part (° C.) | Main Peak Temperature of heat-sealing part (° C.) | Difference (° C.) | Heat Shrinkage (%) | Sealing Temperature (° C.) |
|---|---|---|---|---|---|
| EXAMPLE 1 | 160 | 148 | 12 | 2.2 | 181 |
| EXAMPLE 2 | 162 | 142 | 20 | 2.0 | 183 |
| COMPARATIVE EXAMPLE 1 | 162 | 160 | 2 | 1.8 | 193 |
| COMPARATIVE EXAMPLE 2 | 160 | 132 | 28 | Not measured * | 178 |
| COMPARATIVE EXAMPLE 3 | 160 | 160 | 0 | 1.8 | 193 |
| COMPARATIVE EXAMPLE 4 | 148 | 148 | 0 | 20 | 181 |

* The sample melted in glycerin bath.

EXPLANATION OF SYMBOLS

Figure 1:
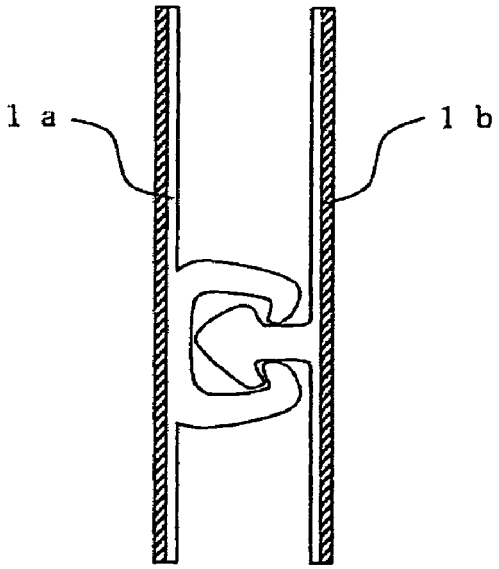
[FIG. 1] The schematic image of an example of the interlocking device wherein the resin compositions of non-sealing and heat-sealing parts are different.
Figure 2:
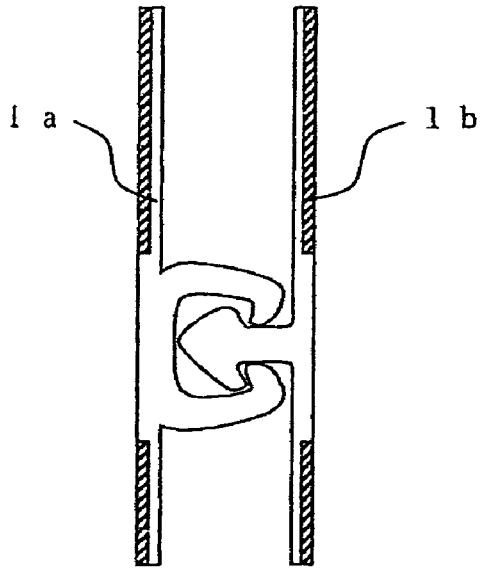
[FIG. 2] The schematic image of another example of the interlocking device wherein the resin compositions of non-heat-sealing and heat-sealing parts are different.
Figure 3:
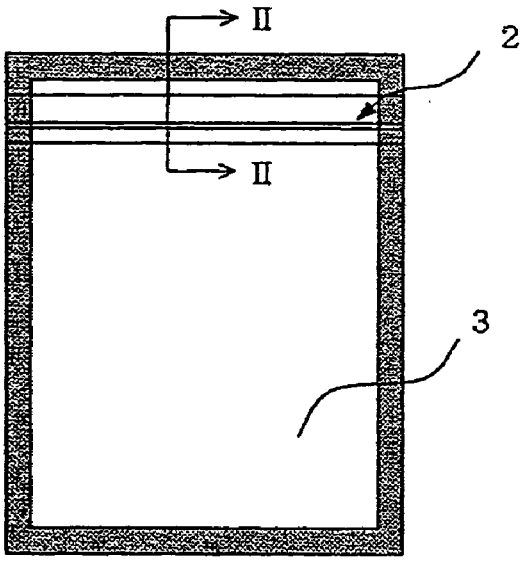
[FIG. 3] The schematic front view of an example of present invention's packaging bag
Figure 4:
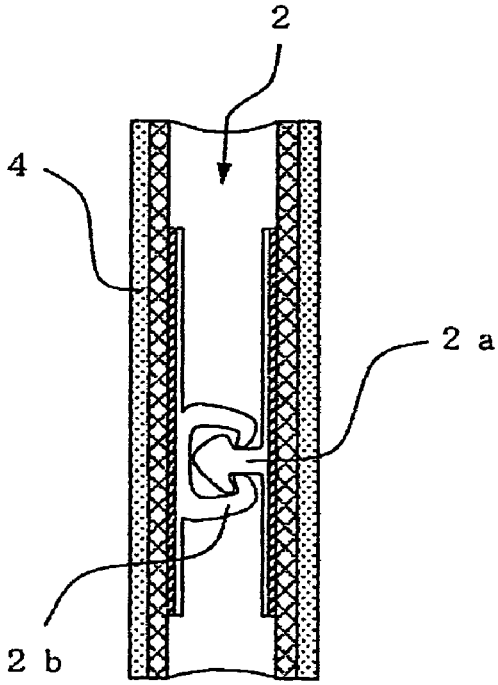
[FIG. 4] The schematic cross sectional view at II—II line in FIG. 3.

1*a* non-heat-sealing part
1*b* heat-sealing part
2 interlocking part
2*a* male profile of interlocking part
2*b* female profile of interlocking part
3 Body of packaging bag with interlocking device
4 Substrate film (OPP/CPP)

What we claim are:

1. An interlocking device comprising a pair of male and female profiles, wherein:

(a) each of said male and female profiles comprises a non-heat-sealing part to a bag body and a heat-sealing part to a bag body, (b) said non-heat sealing part comprises a polypropylene type resin composition (A) having a main melting peak temperature observed by differential scanning calorimetry (DSC), of not less than 150° C. and a melt flow rate at 230° C. of 0.5 g/10 min. to 20 g/10 min.;

(c) said heat sealing part comprises a polypropylene type resin composition (B) having a main melting peak temperature observed by DSC, of not less than 140° C.

and a melt flow rate at 230° C. of 0.1 g/10 min. to 20 g/10 min.;

(d) the main melting peak temperature of composition (B) is at least 10° C. lower than that of composition (A); and (e) the interlocking device does not change more than 3% from its original dimension after being immersed in a 135° C. glycerin bath for 15 minutes and removed from the bath and allowed to cool for 30 minutes.

2. A packaging bag comprising a bag body and the interlocking device according to claim 1, wherein the interlocking device is heat sealed to the bag body via the heat-sealing part.

* * * * *